US011774878B2

(12) United States Patent
Konno et al.

(10) Patent No.: US 11,774,878 B2
(45) Date of Patent: Oct. 3, 2023

(54) AMOUNT-OF-REMAINING-TONER DETECTING DEVICE, IMAGE FORMING APPARATUS, METHOD FOR DETECTING AMOUNT OF REMAINING TONER, AND NON-TRANSITORY RECORDING MEDIUM

(71) Applicants: Ryotaro Konno, Tokyo (JP); Junichi Matsumoto, Kanagawa (JP); Tatsuya Kubo, Kanagawa (JP); Yuki Osato, Tokyo (JP); Yuusuke Tomura, Kanagawa (JP); Masashi Hommi, Kanagawa (JP)

(72) Inventors: Ryotaro Konno, Tokyo (JP); Junichi Matsumoto, Kanagawa (JP); Tatsuya Kubo, Kanagawa (JP); Yuki Osato, Tokyo (JP); Yuusuke Tomura, Kanagawa (JP); Masashi Hommi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/806,297

(22) Filed: Jun. 10, 2022

(65) Prior Publication Data

US 2022/0397853 A1 Dec. 15, 2022

(30) Foreign Application Priority Data

Jun. 15, 2021 (JP) ..... 2021-099626

(51) Int. Cl.
*G03G 15/08* (2006.01)
*G03G 15/00* (2006.01)

(52) U.S. Cl.
CPC ..... *G03G 15/086* (2013.01); *G03G 15/0872* (2013.01); *G03G 15/556* (2013.01);
(Continued)

(58) Field of Classification Search
CPC ..... G03G 15/556; G03G 15/0856; G03G 15/086; G03G 15/0872; G03G 15/087;
(Continued)

(56) References Cited

U.S. PATENT DOCUMENTS 5,987,269 A * 11/1999 Allen ..... G03G 15/086 399/61
2018/0341199 A1* 11/2018 Yamashita ..... G03G 15/556
(Continued)

FOREIGN PATENT DOCUMENTS

JP 7-092802 4/1995
JP 2004-286792 10/2004
(Continued)

*Primary Examiner* — Robert B Beatty
(74) *Attorney, Agent, or Firm* — IPUSA, PLLC

(57) ABSTRACT

An amount-of-remaining-toner detecting device includes: a toner housing portion in which a toner bottle is housed, the toner bottle having a bottle body that is cylindrical and in which toner is housed, and a cap that is attached to one end of the bottle body in an axial direction of the bottle body and from which the toner housed in the bottle body is discharged; and circuitry configured to detect an amount of remaining toner in the toner bottle housed in the toner housing portion. The toner housing portion includes a first pair of electrodes facing each other with the bottle body interposed between the first pair of electrodes, and a second pair of electrodes facing each other with the bottle body interposed between the second pair of electrodes, at respective positions closer to the cap than the first pair of electrodes are. The circuitry detects the amount of remaining toner in the bottle body, based on at least one of a capacitance value between the first pair of electrodes or a capacitance value between the second pair of electrodes.

7 Claims, 8 Drawing Sheets

(52) U.S. Cl.
CPC ..... *G03G 2215/0665* (2013.01); *G03G 2215/0888* (2013.01)

(58) Field of Classification Search
CPC ... G03G 2215/0888; G03G 2215/0663; G03G 2215/0665; G03G 2215/0668; G03G 2215/0685
USPC ..... 399/27, 262
See application file for complete search history.

(56) References Cited

U.S. PATENT DOCUMENTS

| | | | |
|---|---|---|---|
| 2020/0033752 | A1 | 1/2020 | Kubo et al. |
| 2020/0333725 | A1 | 10/2020 | Tomura et al. |

FOREIGN PATENT DOCUMENTS

| | | | | |
|---|---|---|---|---|
| JP | 2016-071299 | | | 5/2016 |
| JP | 2018066789 | A | * | 4/2018 |
| JP | 2020-020888 | | | 2/2020 |
| JP | 2020-034780 | | | 3/2020 |

* cited by examiner

AMOUNT-OF-REMAINING-TONER DETECTING DEVICE, IMAGE FORMING APPARATUS, METHOD FOR DETECTING AMOUNT OF REMAINING TONER, AND NON-TRANSITORY RECORDING MEDIUM

CROSS-REFERENCE TO RELATED APPLICATIONS

This patent application is based on and claims priority pursuant to 35 U.S.C. § 119(a) to Japanese Patent Application No. 2021-099626, filed on Jun. 15, 2021, in the Japan Patent Office, the entire disclosure of which is hereby incorporated by reference herein.

BACKGROUND

Technical Field

The present disclosure relates to an amount-of-remaining-toner detecting device, an image forming apparatus, a method for detecting an amount of remaining toner, and a non-transitory recording medium.

Description of the Related Art

An electrophotographic method is hitherto known as one of image forming methods employed by image forming apparatuses. In the electrophotographic method, an image is developed onto a surface of a photoconductor drum with toner housed in a toner bottle, and the image developed on the photoconductor drum is transferred onto a medium.

There is a technique for detecting an amount of remaining toner in a toner bottle. According to this technique, a pair of electrodes are disposed with a toner bottle interposed between the pair of electrodes in an image forming apparatus that employs the electrophotographic method. The amount of remaining toner in the toner bottle is detected as a change in capacitance value between the electrodes.

In the related art, however, the pair of electrodes face the entire region of the tonner bottle in the axial direction of the toner bottle. Thus, when the amount of remaining toner in the toner bottle is small (hereinafter referred to as "when the toner nearly ends"), a ratio of a capacitance value of an air layer becomes relatively large. This causes an issue of a decreased detection accuracy of the amount of remaining toner.

SUMMARY

According to an aspect of the present disclosure, there is provided an amount-of-remaining-toner detecting device including a toner housing portion and circuitry. In the toner housing portion, a toner bottle is housed. The toner bottle has a bottle body that is cylindrical and in which toner is housed, and a cap that is attached to one end of the bottle body in an axial direction of the bottle body and from which the toner housed in the bottle body is discharged. The circuitry detects an amount of remaining toner in the toner bottle housed in the toner housing portion. The toner housing portion includes a first pair of electrodes and a second pair of electrodes. The first pair of electrodes face each other with the bottle body interposed between the first pair of electrodes. The second pair of electrodes face each other with the bottle body interposed between the second pair of electrodes, at respective positions closer to the cap than the first pair of electrodes are. The circuitry detects the amount of remaining toner in the bottle body, based on at least one of a capacitance value between the first pair of electrodes or a capacitance value between the second pair of electrodes.

According to another aspect of the present disclosure, there is provided an image forming apparatus including the amount-of-remaining-toner detecting device above and an image forming device that forms, with the toner in the toner bottle, an image on a medium.

According to another aspect of the present disclosure, there is provided a method for detecting an amount of remaining toner in a bottle body of a toner bottle housed in a toner housing portion. The toner housing portion includes a first pair of electrodes and a second pair of electrodes. The first pair of electrodes face each other with the bottle body interposed between the first pair of electrodes. The second pair of electrodes face each other with the bottle body interposed between the second pair of electrodes, at respective positions closer to the cap than the first pair of electrodes are. The method includes detecting the amount of remaining toner in the bottle body, based on at least one of a capacitance value between the first pair of electrodes or a capacitance value between the second pair of electrodes.

According to another aspect of the present disclosure, there is provided a non-transitory recording medium storing instructions which, when executed by one or more processors, cause the processors to perform a method for detecting an amount of remaining toner in a bottle body of a toner bottle housed in a toner housing portion. The toner housing portion includes a first pair of electrodes and a second pair of electrodes. The first pair of electrodes face each other with the bottle body interposed the first pair of electrodes. The second pair of electrodes face each other with the bottle body interposed between the second pair of electrodes, at respective positions closer to the cap than the first pair of electrodes are. The method includes detecting the amount of remaining toner in the bottle body, based on at least one of a capacitance value between the first pair of electrodes or a capacitance value between the second pair of electrodes.

BRIEF DESCRIPTION OF THE SEVERAL VIEWS THE DRAWINGS

A more complete appreciation of the disclosure and many of the attendant advantages and features thereof can be readily obtained and understood from the following detailed description with reference to the accompanying drawings, wherein.

Figure 1:
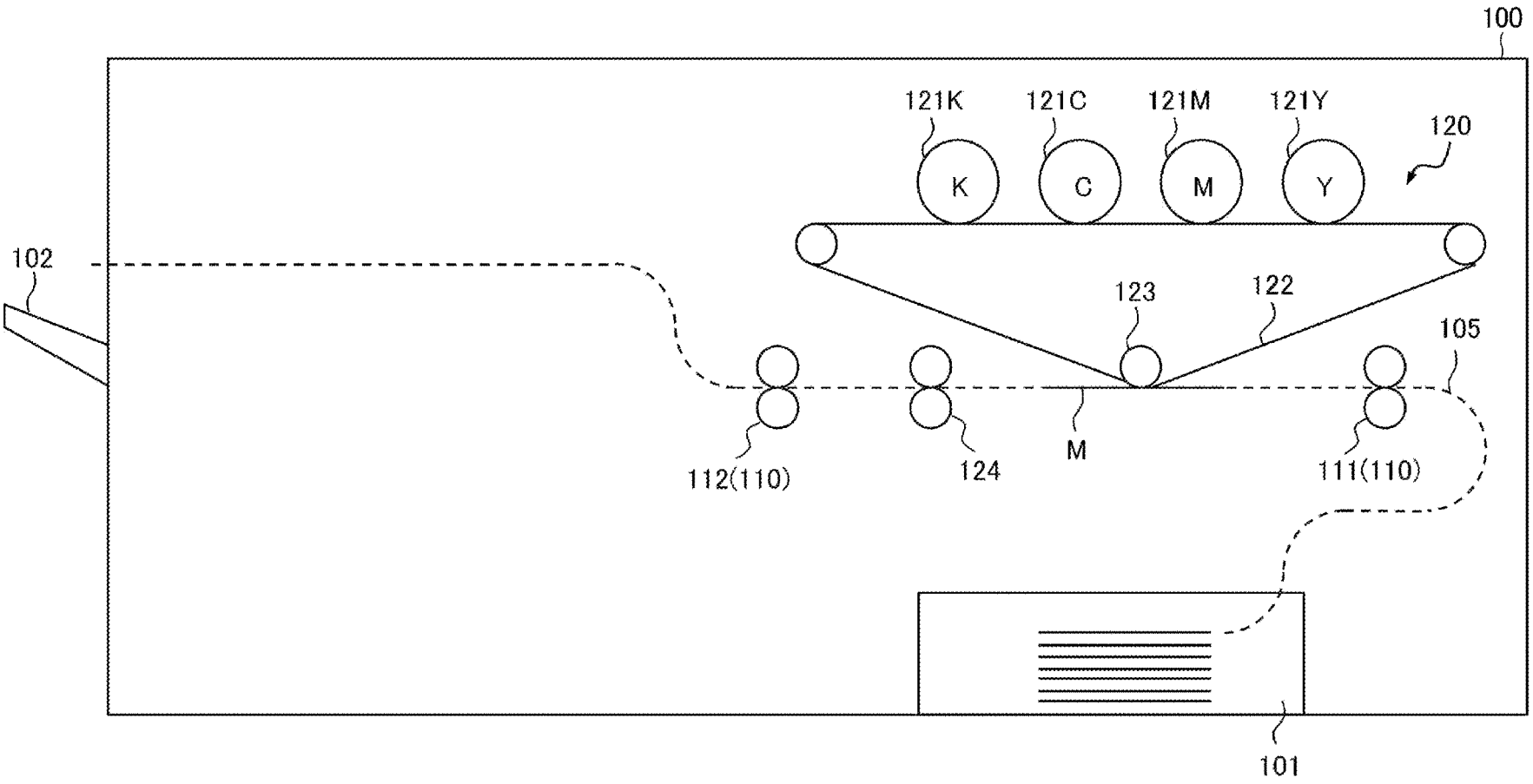
FIG. 1 is a schematic diagram illustrating an internal configuration of an image forming apparatus.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. Referring now to the drawings, embodiments of the present disclosure are described below. As used herein, the singular forms "a," "an," and "the" are intended to include the plural forms as well, unless the context clearly indicates otherwise.

An embodiment of the present disclosure will be described below with reference to the accompanying drawings. FIG. 1 is a schematic diagram illustrating an internal configuration of an image forming apparatus 100 according to an embodiment of the present disclosure. As illustrated in FIG. 1, the image forming apparatus 100 mainly includes a sheet feeding tray 101, a sheet ejection tray 102, a transport device 110, and an image forming device 120. The sheet feeding tray 101 houses a stack of a plurality of sheets M on each of which an image is yet to be formed. The sheet ejection tray 102 houses the sheets M on each of which an image has been formed.

Each of the sheets M is an example of a medium that is transported by the transport device 110 and on which an image is formed by the image forming device 120. Each of the sheets M may be, for example, pre-cut paper having a predetermined size (for example, A4 or B5) or may be long strip-shaped continuous paper. Each of the sheets M is not limited to paper and may be an overhead projector (OHP) sheet or the like. In the image forming apparatus 100, there is a transport path 105 that is a space in which each of the sheets M is transported. The transport path 105 is a path from the sheet feeding tray 101 to the sheet ejection tray 102 through the image forming device 120.

The transport device 110 transports each of the sheets M along the transport path 105. Specifically, the transport device 110 transports each of the sheets M housed in the sheet feeding tray 101 to the position of the image forming device 120 along the transport path 105. The transport device 110 also ejects the sheet M, on which an image has been formed by the image forming device 120, to the sheet ejection tray 102 along the transport path 105.

The transport device 110 includes a plurality of transport rollers 111 and 112. Each of the transport rollers 111 and 112 includes, for example, a driving roller that receives a driving force transmitted from a motor to rotate, and a driven roller that abuts to the driving roller to be driven by the driving roller. The driving roller and the driven roller rotate with each of the sheets M nipped between the driving roller and the driven roller, so that the sheet M is transported along the transport path 105.

The transport roller 111 is located upstream of the image forming device 120 in a transport direction. The transport roller 112 is located downstream of the image forming device 120 in the transport direction. Note that installed positions of the transport rollers are not limited to the two positions illustrated in FIG. 1.

The image forming device 120 faces the transport path 105 between the transport rollers 111 and 112. The image forming device 120 forms an image on a surface of each of the sheets M transported by the transport device 110. The image forming device 120 according to the embodiment forms, with the electrophotographic method, an image on each of the sheets M transported along the transport path 105.

More specifically, the image forming device 120 includes photoconductor drums 121Y, 121M, 121C, and 121K (hereinafter, collectively referred to as "photoconductor drums 121") of respective colors that are arranged along a transfer belt 122 that is an endless moving belt. That is, along the transfer belt 122 on which an intermediate transfer image, to be transferred onto each of the sheets M fed from the sheet feeding tray 101, is to be formed, the plurality of photoconductor drums 121Y, 121M, 121C, and 121K are arranged sequentially from the upstream side of the transfer belt 122 in the transport direction.

Toner housed in each toner bottle 130 (described later) is supplied onto a corresponding one of the photoconductor drums 121. Images of the respective colors developed with the respective toners on the surfaces of the respective photoconductor drums 121 are transferred onto the transfer belt 122 to be superimposed on each other, so that a full-color image is formed. The full-color image formed on the transfer belt 122 is then transferred onto the sheet M with a transfer roller 123 at a position closest to the transport path 105.

The image forming device 120 further includes a fixing roller 124 located downstream of the transfer roller 123 in the transport direction. The fixing roller 124 includes a driving roller that is driven by a motor, and a driven roller that abuts to the driving roller to be driven by the driving roller. When the driving roller and the driven roller of the fixing roller 124 rotate with the sheet M nipped between the driving roller and the driven roller, the sheet M is heated or pressed, so that the image that has been transferred by the transfer roller 123 is fixed to the sheet M.

Figure 2:
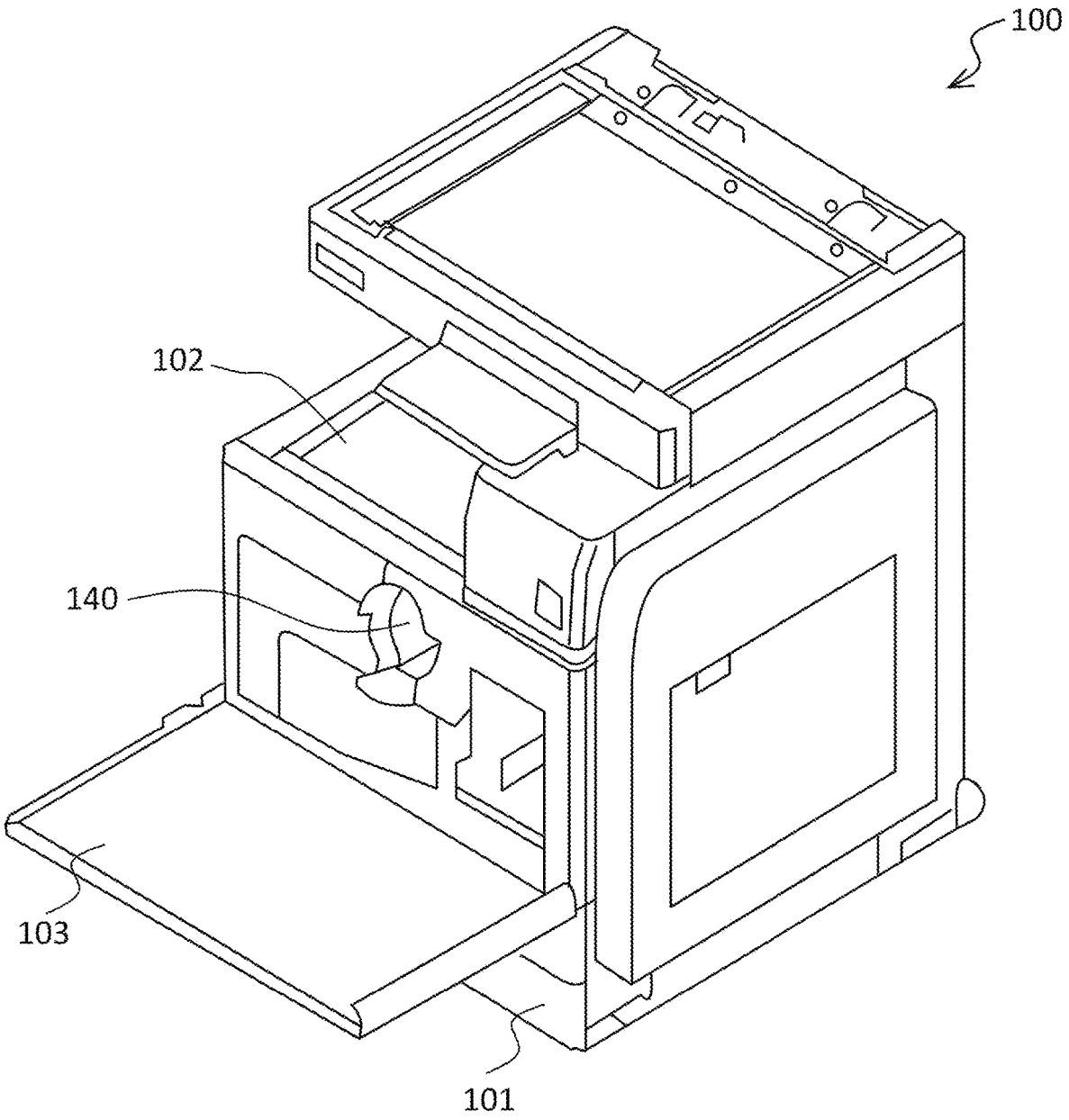
FIG. 2 is an external perspective view of the image forming apparatus.

FIG. 2 is an external perspective view of the image forming apparatus 100. As illustrated in FIG. 2, the image forming apparatus 100 has a cover 103 that is openable and closable, at a front portion of the image forming apparatus 100. When the cover 103 is opened, a toner housing portion 140 to house the toner bottle 130 is exposed. FIG. 2 illustrates one toner housing portion 140. However, the image forming apparatus 100 includes four toner housing portions to respectively house the toner bottles 130 of respective colors (e.g., yellow, magenta, cyan, and black).

Figure 3A:
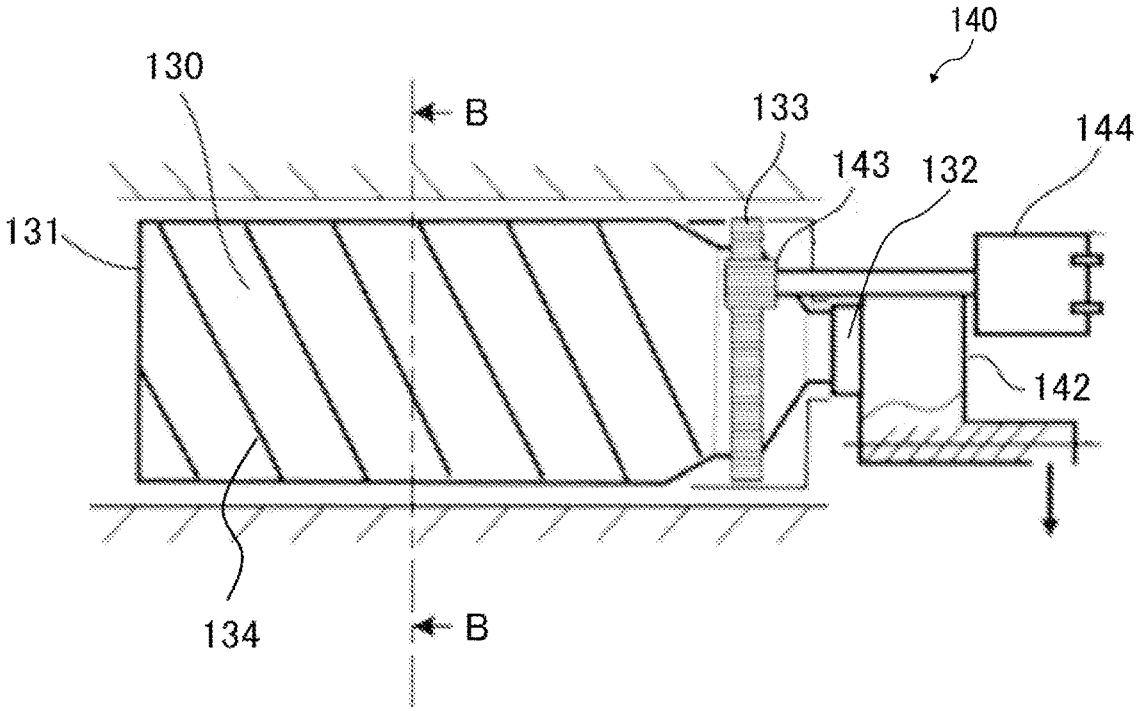
FIGS. 3A and 3B are schematic views of a toner housing portion housing a toner bottle.
Figure 3B:
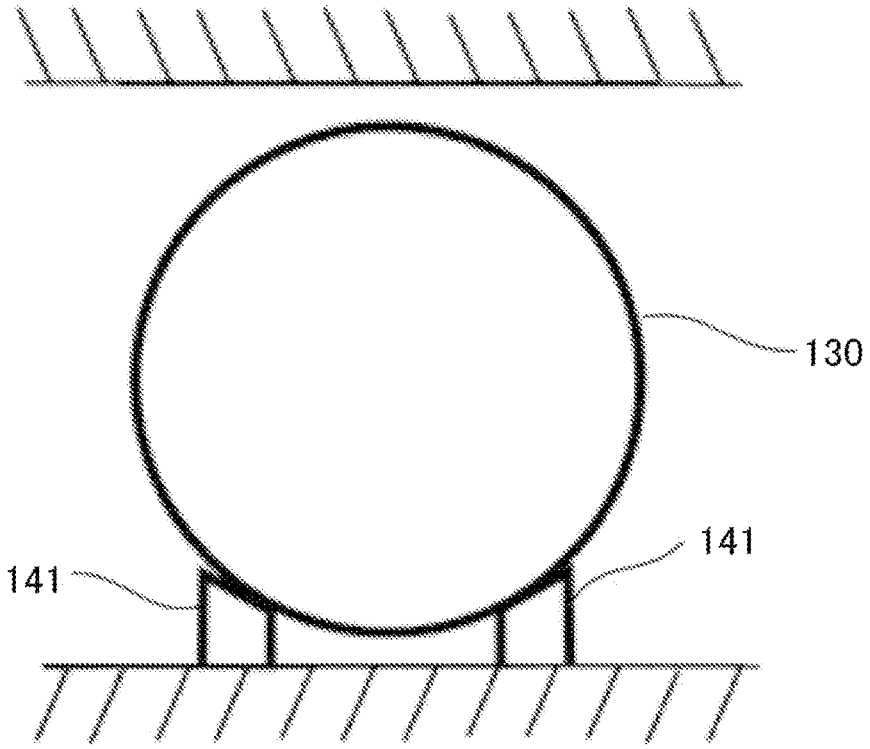
Figure 4A:
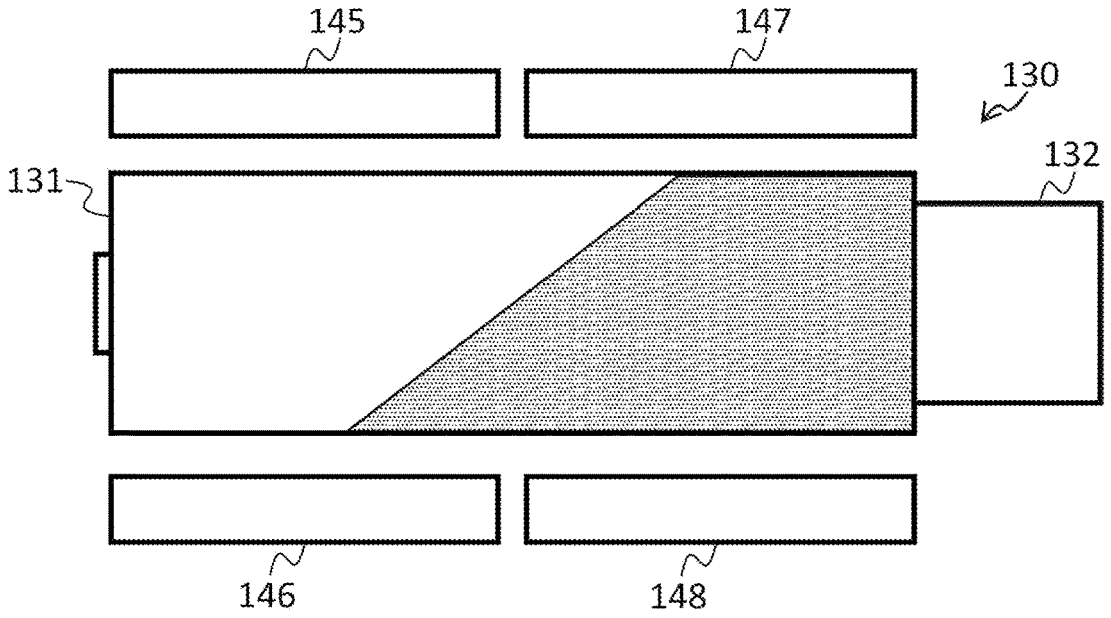
FIGS. 4A and 4B are diagrams illustrating arrangement of the toner bottle and four electrodes.
Figure 4B:
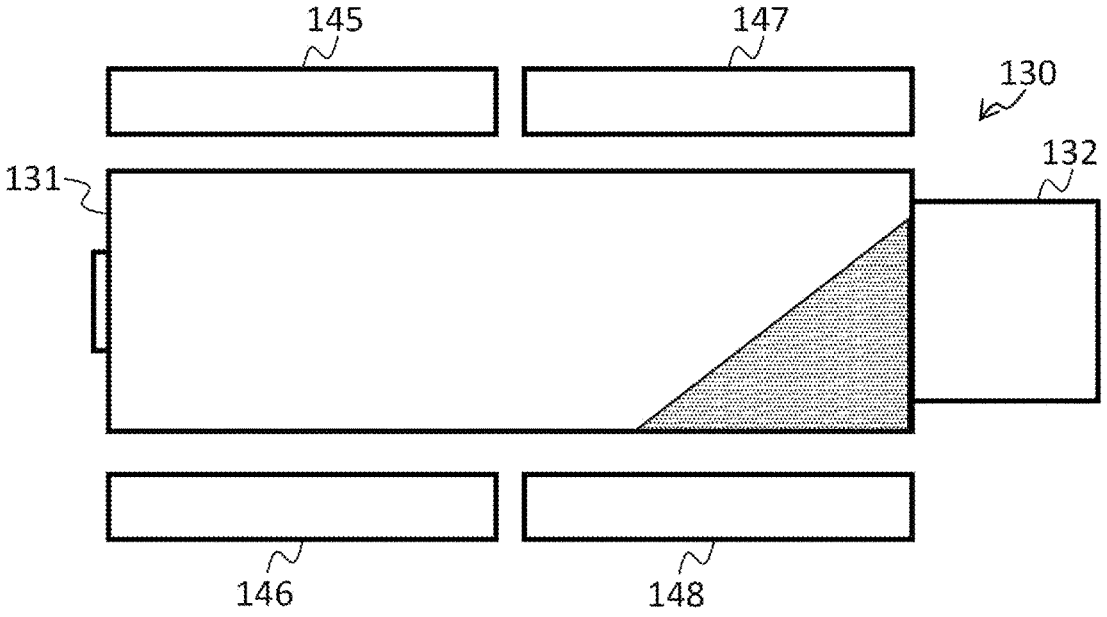

The toner bottle 130 and the toner housing portion 140 will be described in detail next with reference to FIGS. 3A to 4B. FIGS. 3A and 3B are schematic views of the toner housing portion 140 housing the toner bottle 130. FIGS. 4A and 4B are diagrams illustrating arrangement of the toner bottle 130 and four electrodes 145, 146, 147, and 148.

As illustrated in FIG. 3A, the toner bottle 130 mainly includes a bottle body 131 that is cylindrical (tubular) and in which toner is housed, a cap 132 that is attached to a tip (one end in an axial direction) of the bottle body 131, and a gear 133 that is fixed to an outer circumferential surface of the bottle body 131. The bottle body 131 is rotatable relative to the cap 132. The bottle body 131 has a spiral protrusion 134 that protrudes inward from an inner circumferential surface of the bottle body 131 and extends spirally. The cap 132 has a discharge port from which the toner housed in the bottle body 131 is discharged.

The toner housing portion 140 mainly includes two guides 141 (see FIG. 3B), a hopper 142, a driving gear 143, and a driving motor 144. The two guides 141 support the toner bottle 130. The hopper 142 is coupled to the cap 132 and supplies the toner in the toner bottle 130 to the image forming device 120. The driving gear 143 is engaged with the gear 133. The driving motor 144 drives the driving gear 143.

In response to the toner bottle 130 being housed in the toner housing portion 140, the bottle body 131 is supported by the guides 141, the discharge port of the cap 132 is coupled to the hopper 142, and the gear 133 and the driving gear 143 are engaged with each other. When the image forming device 120 forms an image, the driving motor 144 operates.

Thus, a rotational driving force of the driving motor 144 is transmitted to the bottle body 131 through the driving gear 143 and the gear 133 that are engaged with each other, so that the bottle body 131 rotates relative to the cap 132. As a result, the toner in the bottle body 131 moves toward the cap 132 along the spiral protrusion 134 and is supplied to the image forming device 120 through the discharge port of the cap 132 and the hopper 142. That is, the toner in the bottle body 131 is consumed by the image forming device 120 to gradually decrease.

As illustrated in FIGS. 4A and 4B, the toner housing portion 140 includes the four electrodes 145, 146, 147, and 148. The four electrodes 145 to 148 are each made of an electric conductor (for example, iron) plate. The four electrodes 145 to 148 face a side surface of the bottle body 131 with being separate from the side surface by a predetermined space. The four electrodes 145 to 148 extend along the axial direction of the bottle body 131. The four electrodes 145 to 148 have an equal length in the axial direction of the bottle body 131.

The pair of electrodes 145 and 146 (hereinafter sometimes referred to as a "first pair of electrodes 145 and 146") face each other with the bottle body 131 interposed between the pair of electrodes 145 and 146. In the present embodiment, the electrode 145 is located above the bottle body 131, and the electrode 146 is located below the bottle body 131. In the axial direction of the bottle body 131, the pair of electrodes 145 and 146 are located at respective positions farther from the cap 132 than the pair of electrodes 147 and 148 are.

The pair of electrodes 147 and 148 (hereinafter sometimes referred to as "a second pair of electrodes 147 and 148") face each other with the bottle body 131 interposed between the pair of electrodes 147 and 148. In the present embodiment, the electrode 147 is located above the bottle body 131, and the electrode 148 is located below the bottle body 131. In the axial direction of the bottle body 131, the pair of electrodes 147 and 148 are located at respective positions closer to the cap 132 than the pair of electrodes 145 and 146 are.

Figure 5:
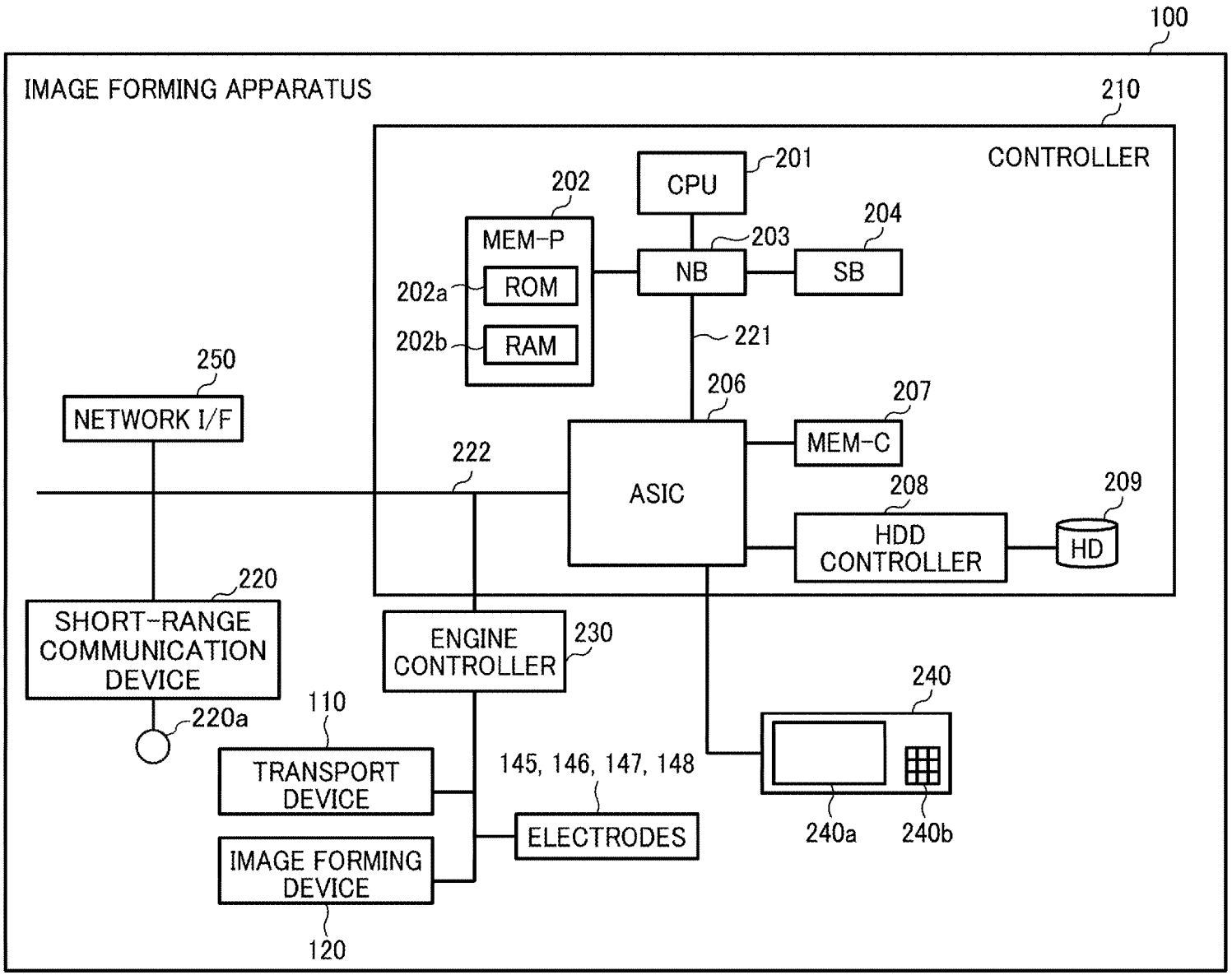
FIG. 5 is a diagram illustrating a hardware configuration of the image forming apparatus.

FIG. 5 is a diagram illustrating a hardware configuration of the image forming apparatus 100, e.g., a multifunction peripheral/product/printer (MFP). As illustrated in FIG. 5, the image forming apparatus 100 includes a controller 210, a short-range communication device 220, an engine controller 230, an operation panel 240, and a network interface (I/F) 250.

The controller 210 includes a central processing unit (CPU) 201 as a main processor of a computer, a system memory (MEM-P) 202, a north bridge (NB) 203, a south bridge (SB) 204, an application specific integrated circuit (ASIC) 206, a local memory (MEM-C) 207 as a memory, a hard disk drive (HDD) controller 208, and a hard disk (HD) 209 as a memory. The NB 203 and the ASIC 206 are coupled to each other by an accelerated graphics port (AGP) bus 221.

The CPU 201 is a controller that controls overall operation of the image forming apparatus 100. The NB 203 is a bridge that couples the CPU 201 to the MEM-P 202, the SB 204, and the AGP bus 221. The NB 203 includes a memory controller that controls reading of data from or writing of data to the MEM-P 202, a Peripheral Component Interconnect (PCI) master, and an AGP target.

The MEM-P 202 includes a read only memory (ROM) 202*a* as a memory that stores a program and data for implementing functions of the controller 210. The MEM-P 202 further includes a random access memory (RAM) 202*b* as a memory that deploys the program and data, and as a drawing memory that stores drawing data for printing. The program stored in the ROM 202*a* may be recorded on a computer-readable recording medium, such as a compact disc-read only memory (CD-ROM), compact disc-recordable (CD-R), or digital versatile disc (DVD), as a file of an installable or executable format, for distribution.

The SB 204 is a bridge that couples the NB 203 to a PCI device and a peripheral device. The ASIC 206 is an integrated circuit (IC) dedicated to an image processing use and including hardware elements for image processing. The ASIC 206 serves as a bridge for coupling the AGP bus 221, a PCI bus 222, the HDD controller 208, and the MEM-C 207 to each other. The ASIC 206 includes a PCI target, an AGP master, an arbiter (ARB) as a central processor of the ASIC 206, a memory controller for controlling the MEM-C 207, a plurality of direct memory access controllers (DMACs) capable of converting coordinates of image data with a hardware logic or the like, and a PCI unit that transfers data to and from the engine controller 230 through the PCI bus 222. A universal serial bus (USB) interface or an Institute of Electrical and Electronics Engineers 1394 (IEEE 1394) interface may be coupled to the ASIC 206.

The MEM-C 207 is a local memory used as an image buffer for copying and a coding buffer. The HD 209 is a storage that stores image data, font data for use in printing, and form data. The HDD controller 208 controls reading of various kinds of data from or writing of various data to the HD 209 under control of the CPU 201. The AGP bus 221 is a bus interface for a graphics accelerator card, which has been proposed to accelerate graphics processing. By enabling a direct access to the MEM-P 202 at a high throughput, the AGP bus 221 can increase the speed of the graphics accelerator card.

The short-range communication device 220 is equipped with a short-range communication circuit 220*a*. The short-range communication circuit 220*a* is a communication circuit in compliance with a standard such as Near Field Communication (NFC) or Bluetooth (registered trademark). The transport device 110, the image forming device 120, and the four electrodes 145 to 148 are coupled to the engine controller 230.

The controller 210 controls the transport device 110 and the image forming device 120 via the engine controller 230 to form an image on the sheet M. The controller 210 measures a capacitance value C1 between the first pair of electrodes 145 and 146 and a capacitance value C2 between the second pair of electrodes 147 and 148. Based on at least one of the measured capacitance value C1 or C2, the controller 210 detects an amount of remaining toner in the toner bottle 130. The toner housing portion 140, the four electrodes 145 to 148, and the controller 210 constitute an amount-of-remaining-toner detecting device.

The operation panel 240 includes a panel display 240*a* such as a touch panel that displays a current setting value, a selection screen, and the like and receives an input from an operator. The operation panel 240 further includes an operation keypad 240*b* including numeric keys that receive a setting value of a condition for image formation such as a setting condition of density, a start key that receives a copy start instruction, and the like.

The network I/F 250 is an interface that enables the image forming apparatus 100 to perform data communication via a communication network. The short-range communication device 220 and the network I/F 250 are electrically coupled to the ASIC 206 via the PCI bus 222. Via the network I/F 250, the controller 210 is capable of transmitting information to an external apparatus and receiving information from the external apparatus.

Figure 6:
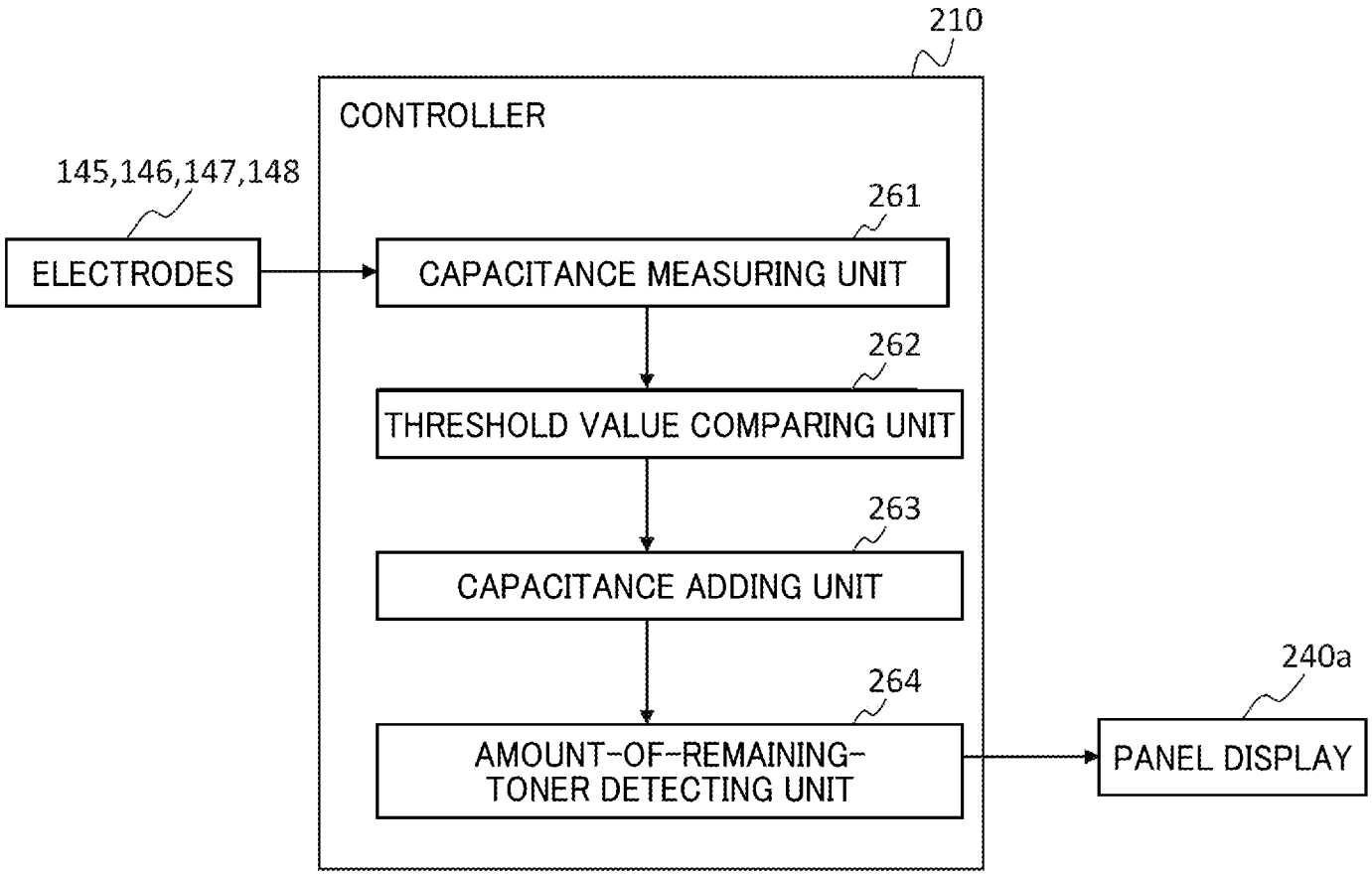
FIG. 6 is a diagram illustrating functional blocks of a controller.

FIG. 6 is a diagram illustrating functional blocks of the controller 210. As illustrated in FIG. 6, the controller 210 includes a capacitance measuring unit 261, a threshold value comparing unit 262, a capacitance adding unit 263, and an amount-of-remaining-toner detecting unit 264. Each of the capacitance measuring unit 261, the threshold value comparing unit 262, the capacitance adding unit 263, and the amount-of-remaining-toner detecting unit 264 illustrated in FIG. 6 is a functional unit that is implemented as a result of the CPU 201 of the controller 210 loading the program stored in the HD 209 to the RAM 202*b* and executing the program.

The capacitance measuring unit 261 measures the capacitance value C1 between the first pair of electrodes 145 and 146 and the capacitance value C2 between the second pair of electrodes 147 and 148. A commonly used method may be used for measuring a capacitance value. In the present embodiment, the measurement is performed using a charging method, in which a constant voltage and a constant current are applied between the electrodes, and the capacitance value is measured from a relationship between a time of a charging reach point and the voltage and current).

The threshold value comparing unit 262 compares the capacitance values C1 and C2 measured by the capacitance measuring unit 261 with predetermined threshold values TH1 and TH2, respectively. The threshold value TH1 is a capacitance value obtained in the case where no toner is housed (that is, an air layer alone is present) in a region, of the bottle body 131, sandwiched by the first pair of electrodes 145 and 146. The threshold value TH2 is a capacitance value obtained in the case where no toner is housed (that is, an air layer alone is present) in a region, of the bottle body 131, sandwiched by the second pair of electrodes 147 and 148. When the first pair of electrodes 145 and 146 and the second pair of electrodes 147 and 148 have an equal length in the axial direction of the bottle body 131, the threshold values TH1 and TH 2 are set to an equal value.

The capacitance adding unit 263 adds the capacitance values that are greater than the respective threshold values TH1 and TH2 among the capacitance values C1 and C2 measured by the capacitance measuring unit 261, to calculate a target capacitance value C. That is, the target capacitance value C may be equal to the capacitance value C1, equal to the capacitance value C2, or equal to the sum of the capacitance values C1 and C2.

Based on the target capacitance value C calculated by the capacitance adding unit 263, the amount-of-remaining-toner detecting unit 264 detects an amount of remaining toner in the toner bottle 130 housed in the toner housing portion 140. Since each of the capacitance values C1 and C2 measured by the capacitance measuring unit 261 changes depending on a permittivity between the electrodes, the capacitance value C1 or C2 increases as the amount of toner (which has a higher permittivity than air) in the toner bottle 130 increases. Thus, for example, based on correspondences between the capacitance value and the amount of remaining toner stored in advance in the HD 209 (memory), the amount-of-remaining-toner detecting unit 264 detects, as an amount of currently remaining toner, the amount of remaining toner corresponding to the target capacitance value C.

The amount-of-remaining-toner detecting unit 264 then causes the detected amount of remaining toner to be displayed on the panel display 240*a*. Causing the amount of remaining toner to be displayed on the panel display 240*a* is an example of outputting an amount of remaining toner. However, a specific method of outputting the amount of remaining toner is not limited to the example described above. The amount of remaining toner may be transmitted to an external apparatus via the network I/F 250, or a warning sound may be output from a speaker when the amount of remaining toner is less than a predetermined amount.

Figure 7:
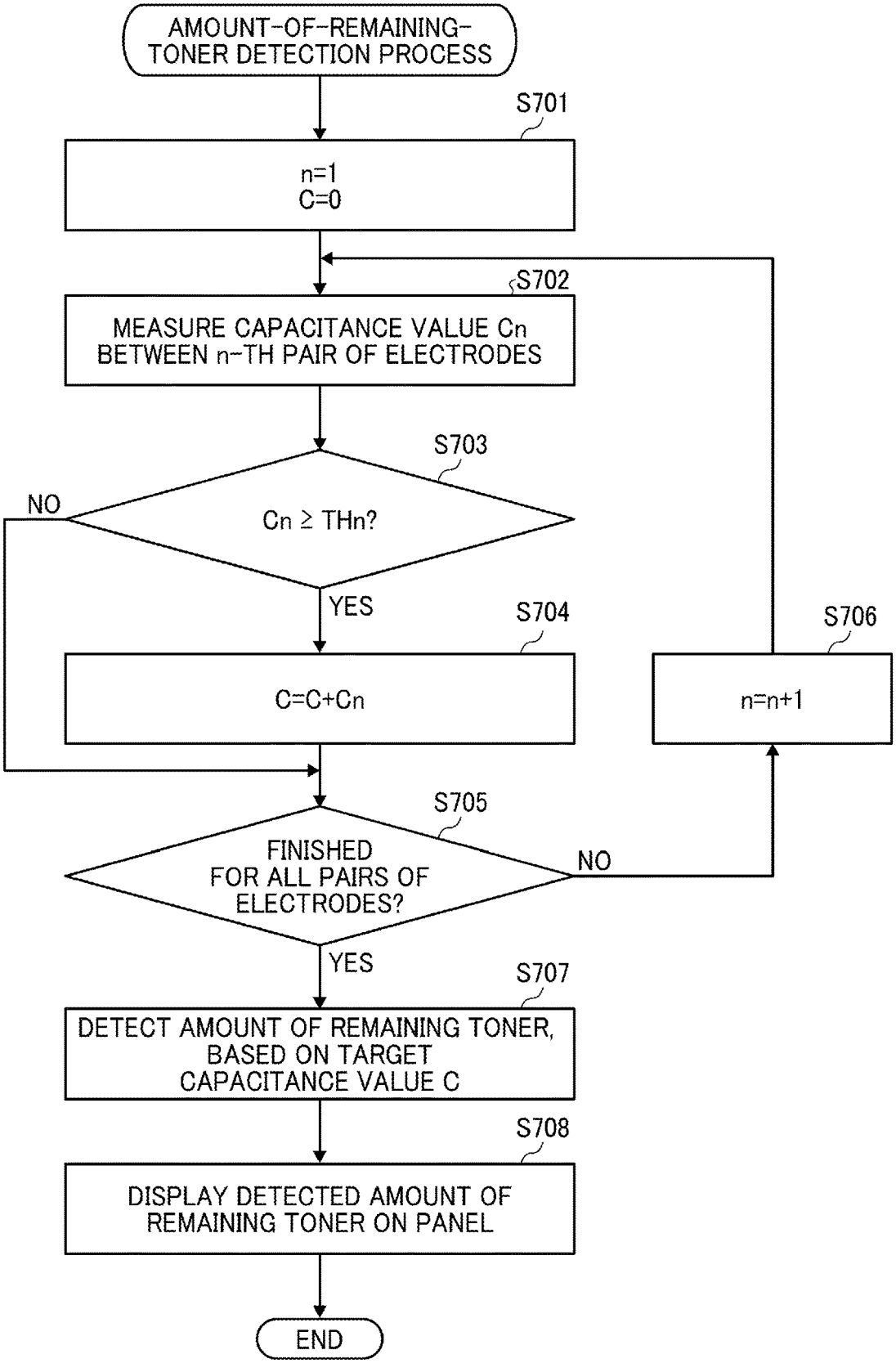
FIG. 7 is a flowchart of an amount-of-remaining-toner detection process.

An amount-of-remaining-toner detection process will be described next with reference to FIGS. 4A, 4B, and 7. FIG. 7 is a flowchart of the amount-of-remaining-toner detection process. For example, the controller 210 may perform the amount-of-remaining-toner detection process in response to an instruction input from an operator via the operation keypad 240*b*, or may repeatedly perform the amount-of-remaining-toner detection process at predetermined time intervals. The controller 210 performs the amount-of-remaining-toner detection process, for each of the toner bottles 130 of the respective colors. Since the processes for the respective colors are the same, the process for one color will be described.

First, the controller 210 initializes a variable n (=1) and the target capacitance value C(=0) (S701). Subsequently, in step S702 when n=1, the capacitance measuring unit 261 of the controller 210 measures the capacitance value C1 between the first pair of electrodes 145 and 146 (S702).

Subsequently, the threshold value comparing unit 262 of the controller 210 compares the capacitance value C1 measured in step S702 with the corresponding threshold value TH1 (S703). If the capacitance value C1 is greater than or equal to the threshold value TH1 (S703: Yes), the capacitance adding unit 263 of the controller 210 adds the capacitance value C1 to the target capacitance value C (S704). On the other hand, if the capacitance value C1 is less than the threshold value TH1 (S703: No), the processing of step S704 is skipped.

Subsequently, the controller 210 determines whether the processing of steps S702 to S704 has been performed for all the pairs of electrodes of the toner housing portion 140 (S705). If it is determined that there is a pair of electrodes for which the processing of steps S702 to S704 has not been performed (S705: No), the controller 210 adds 1 to the variable n (S706) and performs the processing of steps S702 to S704. That is, the controller 210 performs the processing of steps S702 to S704 for all the pairs of electrodes of the toner housing portion 140.

When toner is present in both the region sandwiched by the first pair of electrodes 145 and 146 and the region sandwiched by the second pair of electrodes 147 and 148 in an internal space of the bottle body 131 as illustrated in FIG. 4A, the target capacitance value C is equal to the sum of the capacitance values C1 and C2. On the other hand, when no toner is present in the region sandwiched by the first pair of electrodes 145 and 146 and toner is present in the region sandwiched by the second pair of electrodes 147 and 148 as illustrated in FIG. 4B (that is, when the toner nearly ends), the target capacitance value C is equal to the capacitance value C2. In FIGS. 4A and 4B, the toner is represented by dot hatching.

That is, if the capacitance value C1 between the first pair of electrodes 145 and 146 is less than the threshold value TH1, the controller 210 detects the amount of remaining toner, based on the capacitance value C2 between the second pair of electrodes 147 and 148. On the other hand, if the capacitance value C1 between the first pair of electrodes 145 and 146 is greater than or equal to the threshold value TH1, the controller 210 detects the amount of remaining toner, based on the sum of the capacitance value C1 between the first pair of electrodes 145 and 146 and the capacitance value C2 between the second pair of electrodes 147 and 148.

Subsequently, if the processing of steps S702 to S704 is finished for all the pairs of electrodes of the toner housing portion 140 (S705: Yes), the amount-of-remaining-toner detecting unit 264 of the controller 210 detects the amount of remaining toner in the toner bottle 130, based on the target capacitance value C (S707). Then, the controller 210 displays the amount of remaining toner detected in step S707 on the panel display 240*a* (S708).

The embodiment described above provides, for example, advantages below.

According to the embodiment described above, when the toner nearly ends as illustrated in FIG. 4B, the amount of remaining toner is detected based on the capacitance value C2 between the second pair of electrodes 147 and 148. As described above, the amount of remaining toner is detected without using the capacitance value C1 between the first pair of electrodes 145 and 146 between which the air layer alone is present. Thus, a signal-to-noise (S/N) ratio improves. As a result, a decrease in detection accuracy of the amount of remaining toner is successfully suppressed when the toner nearly ends.

Figure 8A:
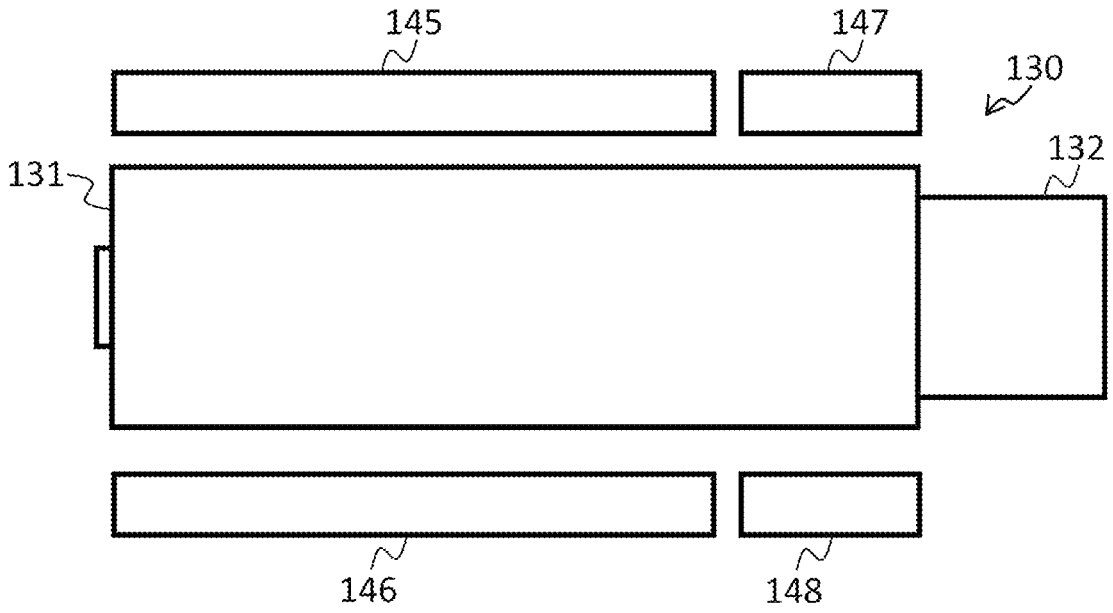
FIGS. 8A and 8B are diagrams illustrating a configuration of electrodes according to modifications.
Figure 8B:
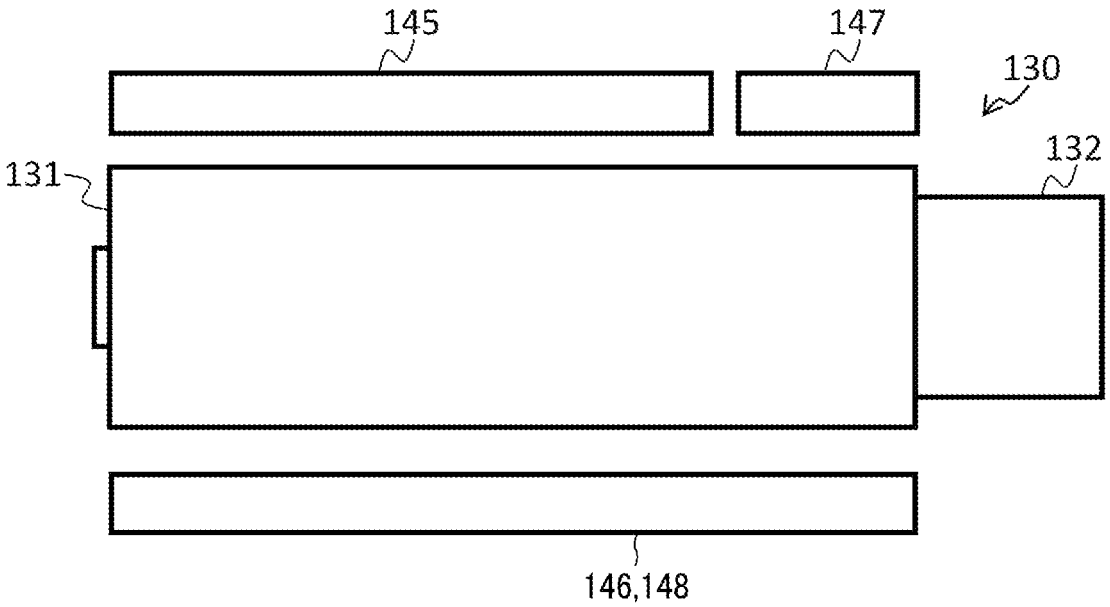

According to the embodiment described above, the commonality of components is implemented as a result of setting the lengths of the electrodes 145 to 148 equal in the axial direction of the bottle body 131. Thus, the manufacturing cost is successfully suppressed. A variation in density of the electric line of force is also reduced. Note that the electrodes 145 to 148 may have different lengths. FIGS. 8A and 8B are diagrams illustrating a configuration of the electrodes 145 to 148 according to modifications.

As illustrated in FIG. 8A, in the axial direction of the bottle body 131, the pair of electrodes 147 and 148 that constitute the second pair of electrodes may have a length shorter than a length of the pair of electrodes 145 and 146 that constitute the first pair of electrodes. The detection accuracy of the amount of remaining toner is desirably high when a replacement timing of the toner bottle 130 approaches. Thus, when the first pair of electrodes 145 and 146 and the second pair of electrodes 147 and 148 have different lengths, the length of the second pair of electrodes 147 and 148 is desirably made shorter than the length of the first pair of electrodes 145 and 146. In this case, the threshold values TH1 and TH 2 are different values (TH1>TH2).

It is known that when the amount of remaining toner is 50 g, the toner is distributed at a toner portion angle of $\theta=20°$. Therefore, in the case of a toner bottle having a common shape (for example, with a length of 40 cm and a diameter of 7 cm), the toner is distributed in a range up to 10 cm from the discharge port in the rotational axial direction of the toner bottle when the toner nearly ends. Thus, if the length of the electrodes 145 are 146 is set to 30 cm and the length of the electrodes 147 and 148 is set to 10 cm, the detection accuracy of the amount of remaining toner is successfully improved when the toner nearly ends.

As illustrated in FIG. 8B, the electrode 146 that is one of the electrodes including the first pair of electrodes and the electrode 148 that is one of the electrodes including the second pair of electrodes may be coupled to each other (integrated together). Thus, the number of components of the image forming apparatus 100 is successfully reduced. In FIG. 8B, the example in which the lower electrodes 146 and 148 are coupled to each other (integrated together) has been described. Alternatively, the upper electrodes 145 and 147 may be coupled to each other (integrated together).

FIGS. 4A, 4B, 8A, and 8B illustrate two pairs of electrodes. Alternatively, the toner housing portion 140 may include three or more pairs of electrodes. In FIGS. 4A, 4B, 8A, and 8B, an example in which the pair of electrodes including an electrode pair face each other in the vertical direction has been described. However, the arrangement of the pair of electrodes is not limited to the example described above. The pair of electrodes may face each other in the horizontal direction. In FIG. 8B, the electrode 145 may be omitted.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor. The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The invention claimed is:

1. An amount-of-remaining-toner detecting device comprising:

a toner housing portion in which a toner bottle is housed, the toner bottle having a bottle body that is cylindrical and in which toner is housed, and a cap that is attached to one end of the bottle body in an axial direction of the bottle body and from which the toner housed in the bottle body is discharged; and circuitry configured to detect an amount of remaining toner in the toner bottle housed in the toner housing portion, wherein the toner housing portion comprises a first pair of electrodes facing each other with the bottle body interposed between the first pair of electrodes, and a second pair of electrodes facing each other with the bottle body interposed between the second pair of electrodes, at respective positions closer to the cap than the first pair of electrodes are, wherein the circuitry is configured to detect the amount of remaining toner in the bottle body, based on at least one of a capacitance value between the first pair of electrodes or a capacitance value between the second pair of electrodes, and wherein the second pair of electrodes have a length shorter than a length of the first pair of electrodes in the axial direction of the bottle body.

2. The amount-of-remaining-toner detecting device according to claim 1, wherein the circuitry is configured to detect the amount of remaining toner, based on a sum of capacitance values greater than or equal to a predetermined threshold value among the capacitance value between the first pair of electrodes and the capacitance value between the second pair of electrodes.

3. The amount-of-remaining-toner detecting device according to claim 1, wherein one electrode of the first pair of electrodes and one electrode of the second pair of electrodes are coupled to each other.

4. An image forming apparatus comprising:

the amount-of-remaining-toner detecting device according to claim 1; and an image forming device configured to form, with the toner in the toner bottle, an image on a medium.

5. A method for detecting an amount of remaining toner in a bottle body of a toner bottle housed in a toner housing portion, the toner housing portion comprising a first pair of electrodes facing each other with the bottle body interposed between the first pair of electrodes, and a second pair of electrodes facing each other with the bottle body interposed between the second pair of electrodes, at respective positions closer to the cap than the first pair of electrodes are, the second pair of electrodes having a length shorter than a length of the first pair of electrodes in an axial direction of the bottle body, the method comprising:

detecting the amount of remaining toner in the bottle body, based on at least one of a capacitance value between the first pair of electrodes or a capacitance value between the second pair of electrodes.

6. An amount-of-remaining-toner detecting device comprising:

a toner housing portion in which a toner bottle is housed, the toner bottle having a bottle body that is cylindrical and in which toner is housed, and a cap that is attached to one end of the bottle body in an axial direction of the bottle body and from which the toner housed in the bottle body is discharged; and circuitry configured to detect an amount of remaining toner in the toner bottle housed in the toner housing portion, wherein the toner housing portion comprises a first pair of electrodes facing each other with the bottle body interposed between the first pair of electrodes, and a second pair of electrodes facing each other with the bottle body interposed between the second pair of electrodes, at respective positions closer to the cap than the first pair of electrodes are, wherein the circuitry is configured to detect the amount of remaining toner in the bottle body, based on at least one of a capacitance value between the first pair of electrodes or a capacitance value between the second pair of electrodes, and wherein one electrode of the first pair of electrodes and one electrode of the second pair of electrodes are coupled to each other.

7. An image forming apparatus comprising:

the amount-of-remaining-toner detecting device according to claim 6; and an image forming device configured to form, with the toner in the toner bottle, an image on a medium.

* * * * *